US008151784B2

(12) United States Patent
Czajkoski

(10) Patent No.: US 8,151,784 B2
(45) Date of Patent: Apr. 10, 2012

(54) COLLAPSIBLE GRILL AND STAND

(75) Inventor: William A. Czajkoski, Custer Park, IL (US)

(73) Assignee: Raymond Hubert, St. Anne, IL (US)

( * ) Notice: Subject to any disclaimer, the term of this patent is extended or adjusted under 35 U.S.C. 154(b) by 596 days.

(21) Appl. No.: 12/099,849

(22) Filed: Apr. 9, 2008

(65) Prior Publication Data

US 2008/0184980 A1 Aug. 7, 2008

Related U.S. Application Data

(63) Continuation-in-part of application No. 11/332,414, filed on Jan. 13, 2006, now abandoned, and a continuation-in-part of application No. 10/613,312, filed on Jul. 7, 2003, now Pat. No. 7,013,885.

(60) Provisional application No. 60/911,008, filed on Apr. 10, 2007.

(51) Int. Cl.
*F24B 3/00* (2006.01)

(52) U.S. Cl. ..... 126/30; 126/9 R; 126/25 A; 126/25 R; 126/29; 126/506; 99/450; 248/7; 248/121; 248/161; 248/165

(58) Field of Classification Search ..... 126/30, 126/9 R, 29, 506, 25 A, 25 R; 248/161, 188, 248/7, 121, 165; 99/450
See application file for complete search history.

(56) References Cited

U.S. PATENT DOCUMENTS

| | | | | | |
|---|---|---|---|---|---|
| 2,844,139 | A | * | 7/1958 | Lucas | 126/30 |
| 2,912,973 | A | * | 11/1959 | Lucas | 126/30 |
| 3,067,734 | A | * | 12/1962 | Lucas | 126/30 |
| 3,152,536 | A | * | 10/1964 | Lucas | 99/397 |
| 3,874,623 | A | | 4/1975 | Moulton | |
| 4,065,085 | A | | 12/1977 | Gellatly | |
| 4,117,825 | A | | 10/1978 | Robertson | |
| 4,230,089 | A | * | 10/1980 | Barden | 126/30 |
| 4,538,589 | A | * | 9/1985 | Preston | 126/30 |
| 4,553,525 | A | | 11/1985 | Ruble | |
| 4,766,879 | A | | 8/1988 | Freese | |
| 4,854,297 | A | * | 8/1989 | Shuman | 126/30 |
| 4,896,651 | A | | 1/1990 | Kott, Jr. | |
| 4,979,490 | A | | 12/1990 | Nudo et al. | |
| 5,287,844 | A | | 2/1994 | Fieber | |
| 5,447,096 | A | * | 9/1995 | Burge et al. | 99/339 |
| 5,944,009 | A | | 8/1999 | Scheller | |
| 6,789,447 | B1 | * | 9/2004 | Zinck | 81/57.13 |

* cited by examiner

*Primary Examiner* — Steven B McAllister
*Assistant Examiner* — Avinash Savani
(74) *Attorney, Agent, or Firm* — Miller, Matthias & Hull LLP

(57) ABSTRACT

A portable grill is described. The portable grill has a grill member, a frame, and a support arm. The frame supports the portable grill on a support surface. The support arm extends outwardly from the frame. The support arm has a distal end and a proximal end. The distal end is joined to the grill member. The proximal end is pivotally joined to the frame forming a fulcrum therewith. The support arm is pivotable about the fulcrum to raise and lower the grill member relative to the support surface while maintaining the grill member substantially level.

8 Claims, 4 Drawing Sheets

COLLAPSIBLE GRILL AND STAND

RELATED APPLICATION

This application is a Continuation-in-Part of U.S. patent application Ser. No. 11/332,414 filed Jan. 13, 2006, currently pending, which is a Continuation-in-Part of U.S. patent application Ser. No. 10/613,312 filed Jul. 7, 2003, now U.S. Pat. No. 7,013,885 issued Mar. 21, 2006. This application also claims priority to U.S. Provisional Application Ser. No. 60/911,008 filed on Apr. 10, 2007. The applications are commonly owned and incorporated by reference herein as if fully set forth herein.

TECHNICAL FIELD

This invention relates to the field of grills, and stands for grills, which burn combustible materials such as charcoal and the like, and particularly to those which can be folded or collapsed into a compact unit for purposes of storage, portability and the like. Furthermore the invention relates to grills which can be used indoors over a fireplace, having a grill stand which makes it possible to position and support the grill member over the burning logs, charcoal or gas within the fireplace and under the flue so the smoke, gases, odors and heat are exhausted to the outside through the flue and do not enter the interior of the room or building.

BACKGROUND OF THE INVENTION

Charcoal grills and those which use other combustible material that are known to the prior art cannot be used indoors because the smoke, gases, odors and heat would be trapped in the room and would create a fire hazard. The collapsible grill and stand in accordance with this invention solves that problem. Some prior art grills and stands are partially collapsible or foldable, or can be partially disassembled into a more compact unit for purposes of storage or transport and the like. However, those known to the prior art require a relatively large fire pot or bowl in which to place and burn the charcoal, and such pot or bowl is a unitary structure which cannot be collapsed or folded into a smaller more compact unit. Thus, even when prior art grills can be partially collapsed or folded, the relatively large fire pot or bowl still remains as the largest most bulky component making such grills still hard to store and transport. They still require a relatively large space or compartment for storage and are still cumbersome to carry or otherwise transport. The collapsible grill and stand in accordance with this invention solves that problem since it does not require a fire pot or bowl at all. The grill stand has been constructed in such a way that it can position and support the flat grill member itself outwardly from the stand and over an indoor fireplace, or over a campfire on the ground when used outdoors.

SUMMARY OF THE INVENTION

The present invention is directed to a portable grill comprising:

- a grill member;
- a frame for supporting the portable grill on a support surface; and
- a support arm extending outwardly from the frame, the support arm having a distal end and a proximal end, the distal end joined to the grill member, the proximal end pivotally joined to the frame forming a fulcrum, the support arm pivotable about the fulcrum to raise and lower the grill member relative to the support surface while maintaining the grill member substantially level.

The support arm may comprise a pair of parallel members and a bracket. Each parallel member may have a first end pivotally attached to the bracket and a second end including the pivotal attachment to the frame. The grill member is joined to the bracket.

The support arm may further comprise an outer member fixedly attached to the bracket at a fixed end and having a free end joined to the grill member.

The portable grill may further comprising a locking mechanism for maintaining the grill member at a fixed height above the support surface. The locking mechanism may comprise a graduated segment joined to one of the parallel members. The graduated segment may have a plurality of stops joined by tapered portions. The locking mechanism may further comprise a retainer extending from the opposite parallel member towards the graduated segment. The retainer is for engaging at least one of the stops. The retainer may be located on a V-shaped trigger which is pivotally joined to one of the parallel members. The V-shaped trigger may include a first leg and a second leg separated by an apex. The second leg may have a channel adapted to fit over the graduated segment. The retainer may be located at the apex of the trigger within the channel of the second leg.

The portable grill may further comprise a handle extendable from the support arm.

A second aspect of the present invention is directed to a portable grill stand comprising:

- a frame for supporting the portable grill on a support surface;
- a support arm extending outwardly from the frame, the support arm comprising a pair of parallel members, each parallel member having a distal end pivotally attached to a bracket and a proximal end pivotally attached to the frame to form a fulcrum at the frame; and
- a grill member joined to the bracket, the grill member having a grilling surface wherein the grill surface may be raised and lowered by pivoting the support arm about the fulcrum wherein the grilling surface is maintained substantially level during raising and lowering of the grill member.

Another aspect of the present invention is directed to a portable grill stand comprising:

- a frame for supporting the portable grill on a support surface, the frame comprising:
  - a center post;
  - a plurality of legs attached to the center post; and
  - a yoke attached to an upper end of the center post and rotatably mounted thereto;
- a support arm extending outwardly from the frame, the support arm comprising:
  - an outer member having a free end and a fixed end;
  - a bracket attached to the fixed end of the outer member;
  - a pair of spaced parallel booms, each boom having a distal end and a proximal end, the distal end of each boom pivotally attached to the bracket, the proximal end of each boom pivotally mounted to the yoke to form a fulcrum therewith; and
  - a handle located opposite the outer member;
- a grill member, the grill member having a grilling surface and being joinable to the free end of the outer member of the support arm; and
- wherein the grilling surface may be raised and lowered relative to the support surface by pivoting the support arm on the fulcrum and wherein the grilling surface remains substantially level as the support arm is pivoted on the fulcrum.

Another aspect of the present invention is directed to a portable grill comprising:

a frame for supporting the portable grill on a support surface;

a support arm extending outwardly from the frame having first and second opposing ends;

a grill member having a substantially horizontally aligned grilling surface;

a first pivotable connector joining the support arm with the frame between the first and second ends of the support arm and forming a fulcrum therewith such that the support arm forms a lever vertically pivotable about the fulcrum; and a second pivotable connector between the first pivotable connector and the grill member such that the grill surface elevates and lowers in response to the support arm pivoting about the fulcrum while remaining substantially horizontally aligned.

The support arm for this aspect of the portable grill further comprise:

a bracket, the second pivotable connector located on the bracket.

The portable grill of this aspect may further comprise:

an outer arm fixedly attached to the bracket and extending outwardly therefrom and joining the grill member with the bracket.

The support arm of this aspect of the invention may further comprise:

a pair of boom members wherein one end of each boom member is pivotally attached to the bracket by the second pivotable connector.

The portable grill of this aspect may still further comprise:

a yoke attached to the frame wherein the first pivotable connector is located on the yoke and opposing ends of each boom member are pivotally connected to the yoke by the first pivotable connector.

The first and second pivotable connectors of this aspect of the invention may each include a pair of pivot points. The boom members of this aspect of the invention may be parallel to each other wherein a first boom is located in vertical alignment with a second boom. The yoke may be rotatably mounted to the frame.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
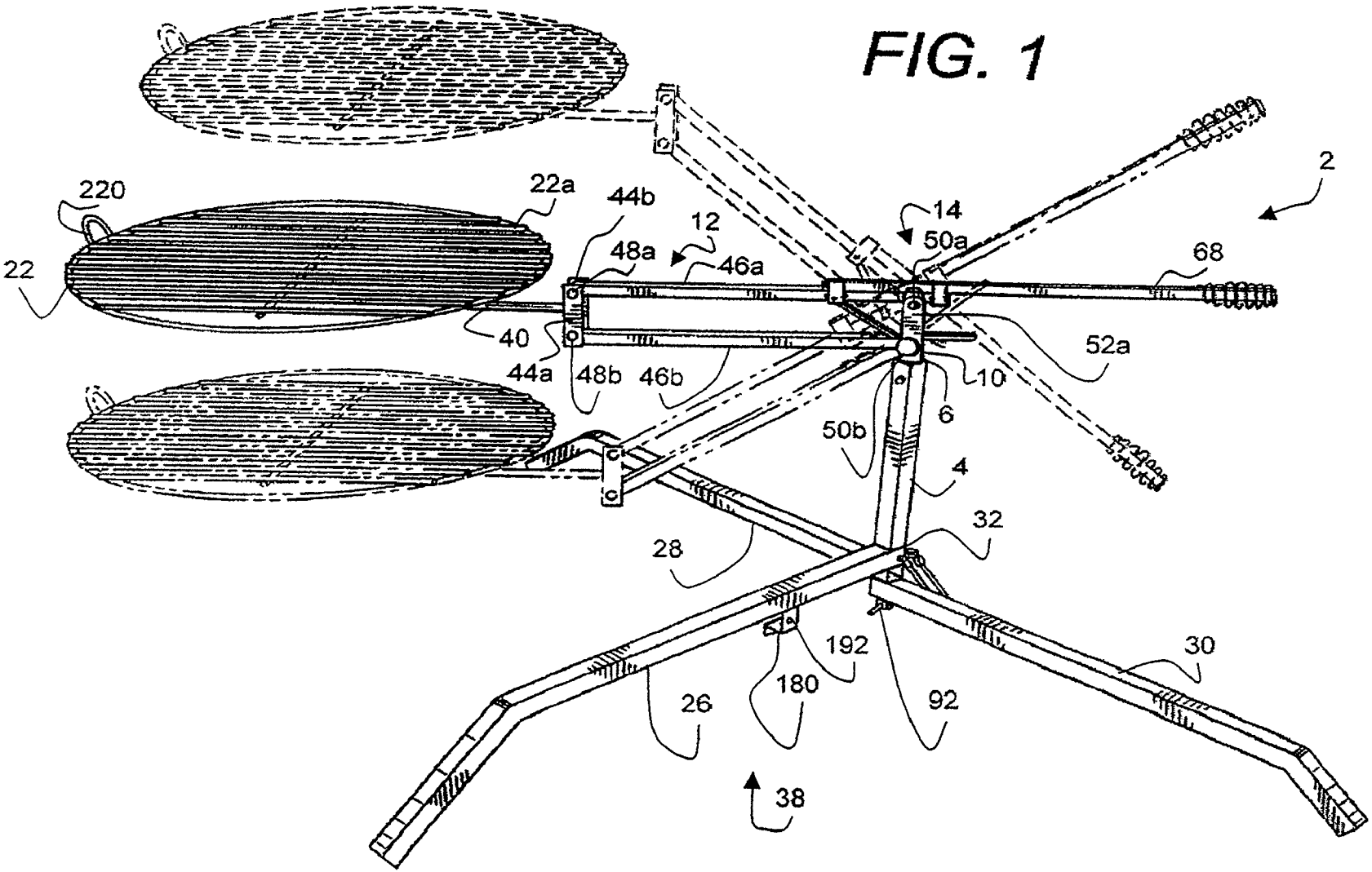
FIG. 1 is a perspective view of a collapsible grill and stand in accordance with this invention.
Figure 2:
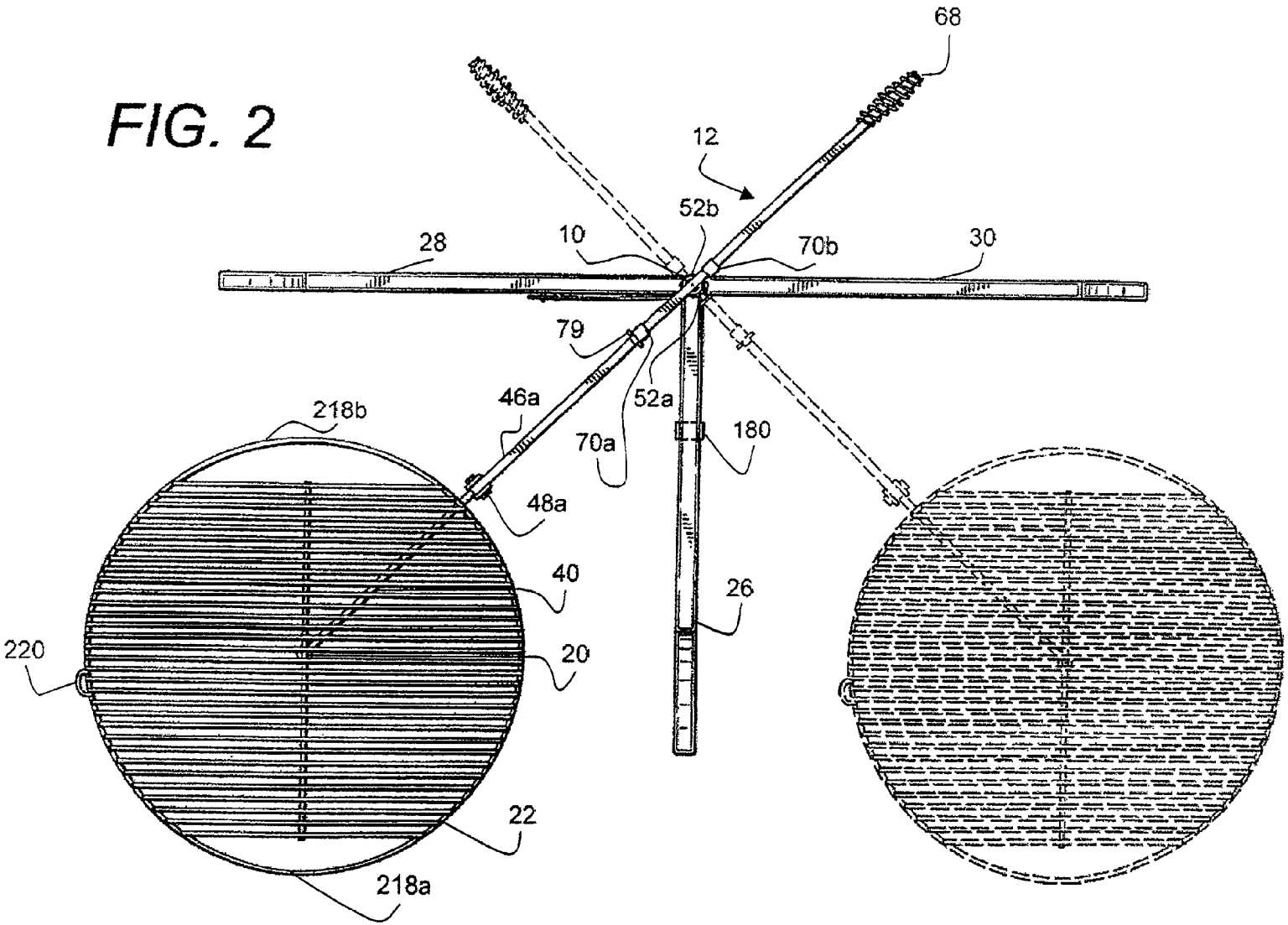
FIG. 2 a top view of the collapsible grill of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is related to improvements to a collapsible grill and stand for a portable grilling unit such as the ones described in U.S. Pat. No. 7,013,885 and U.S. Publication No. 2006/112950A1 which share common inventorship and are commonly owned and hereby incorporated by reference herein as if fully set forth herein.

Now referring to FIGS. 1-5, a collapsible grill and stand 2 is illustrated. Accordingly, this embodiment of the collapsible grill and stand 2 comprises a frame for supporting the grill on a support surface, the frame including an upright center post 4 with a central passageway 6, and a grill supporting assembly which comprises a forked yoke 10 received in the central passageway 6 of the upright center post 4. The grill also includes a height adjusting mechanism 14 to raise and lower flat grill member 22 and a support arm 12. A spindle 16 extends upright at the outer end 18 of the laterally extending support arm 12 to receive a hub 20 of the flat grill member 22 thereon to support the grill member 22 for use over a campground fire.

The grill frame also includes an anti-teetering support system. This includes three laterally extending support legs 26, 28 and 30 projecting outwardly from the lower end 32 of the upright center post 4. One of the support legs 26 is rigidly affixed to the lower end of the center post 4 and extends laterally and radially outwardly therefrom. The other support legs 28 and 30 are rotatable or radially pivotable around an axis of the center post to any selected radial and spaced apart position that will support the grill member 22 at its location at the outer end of the laterally extending support arm 12 over a fire. For example, the support legs can be rotated to form a Y-shaped configuration with two of the support legs 26 and 28 forming the diverging fork portion 38 of the Y which are placed facing the fireplace or campground fire and the third support leg 30 rotated to form the leg of the Y that extends away from the fireplace or campground fire. The legs 28 and 30 are preferably rotated at a 90 degree angle to leg 26 to form a T-shape. That radial positioning of the support legs will support the grill 22 at the outer end of the laterally extending support arm 12 and prevent it from tipping over. None of the support legs have to be positioned below the grill member 22 itself where the fire is burning to prevent the grill member 22 from tipping. The support leg 30 need not extend directly away from the fork portion 38 formed by the support legs 26 and 28 to form a T configuration, but support leg 30 can be rotated to any radial position away from the fork portion 38 that will stabilize the grill and stand 2.

The height adjustment or lifting mechanism 14 is capable of maintaining a grill surface 22*a* level or substantially level throughout a range of height adjustments. This is preferably accomplished by a pair of pivotable connectors in combination with the support arm 12 which preferably includes an adjustable, geometrically-shaped twin parallel beam boom assembly. Each pivotable connector preferably includes a pair of pivot points as will be described in more detail below.

The support arm 12 includes the outer member 40. Outer member 40 is fixedly attached to bracket 42 at a fixed end. The grill member 22 is joinable to a free end of the outer member 40. The bracket 42 includes a pair of spaced parallel plates 44*a*,44*b*. Outer member 40 is inserted between the plates 44*a*,44*b* and is fixed by welding or other suitable fixed attachment means, including but not limited to mechanical fasteners such as nuts, bolts and screws, and chemical fasteners such as epoxy. A pair of vertically aligned parallel members 46*a*,46*b* are attached to the bracket 42 by a pivotable connector which preferably includes a pair of pivot points defined by attachment pins 48*a*, 48*b*, which preferably include threaded nuts attached to threaded bolts. At opposing ends, the parallel members 46*a*,46*b* are attached to the yoke 10 by another pivotable connector which also preferably includes a pair of pivot points defined by attachment pins 50*a*, 50*b*, which are preferably threaded nuts attacked to threaded bolts, between upwardly extending, spaced parallel tines or plates 52*a*,52*b*.

The lifting mechanism 14 works in conjunction with the pivot points and the support arm 12 to raise and lower the grill surface 22*a* while maintaining the grill surface 22*a* on a substantially horizontal plane. Thus, the support arm 12 is pivotable about a fulcrum defined by the pivotable connector joining the support arm 12 with the frame to raise and lower the grill member 22 relative to the support surface while maintaining the grill member 22 substantially level. "Substantially level" is intended to indicate a degree of levelness suitable for maintaining grilling items on the grill surface 22*a*, such that the grilling items do not roll off of the grilling surface 22*a*.

In other words, the grill surface 22*a* can be raised and lowered without angular deflection of the grill surface 22*a* relative to the center post 4. The raising and lowering is best illustrated in FIG. 1. This is accomplished by establishing the fulcrum defined by the attachment pin 50*a*,50*b* location on the forked yoke 10. Stated another way, the forked yoke 10 is laterally or vertically fixed to or within the center post 4. It does not telescope from the center post or otherwise raise and lower to adjust the height of the grill member 22. The height of the grill member 22 is controlled by the pivoting of the support arm 12 about the fulcrum on the forked yoke 10. Because the parallel members 46*a*,46*b* are pivotally fixed at opposing ends, they remain in parallel relationship as the support arm 12 is pivoted about the fulcrum. Thus, the bracket 42 can be raised and lowered by pivoting the support arm 12 about the fulcrum. And because the parallel members 46*a*, 46*b* are pivotally attached to the bracket 42, an orientation of the bracket 42 remains constant throughout the pivoting action, preferably perpendicular to a substantially horizontal plane. This is particularly advantageous because it allows the outer member 40 to also remain at a constant orientation, or angle, relative to a horizontal plane which, in turn, allows an orientation of the grill member 22 to remain at a constant orientation, or angle, with respect to a horizontal plane or a base surface from a first height above the base surface to a plurality of heights above and below the first height. The primary advantage is a lifting mechanism which is pivotal at a discreet point spaced from a source of heat and which allows single handed lifting of the grill member without angular deflection of a grill member surface 22*a* relative to the source of heat.

Figure 3:
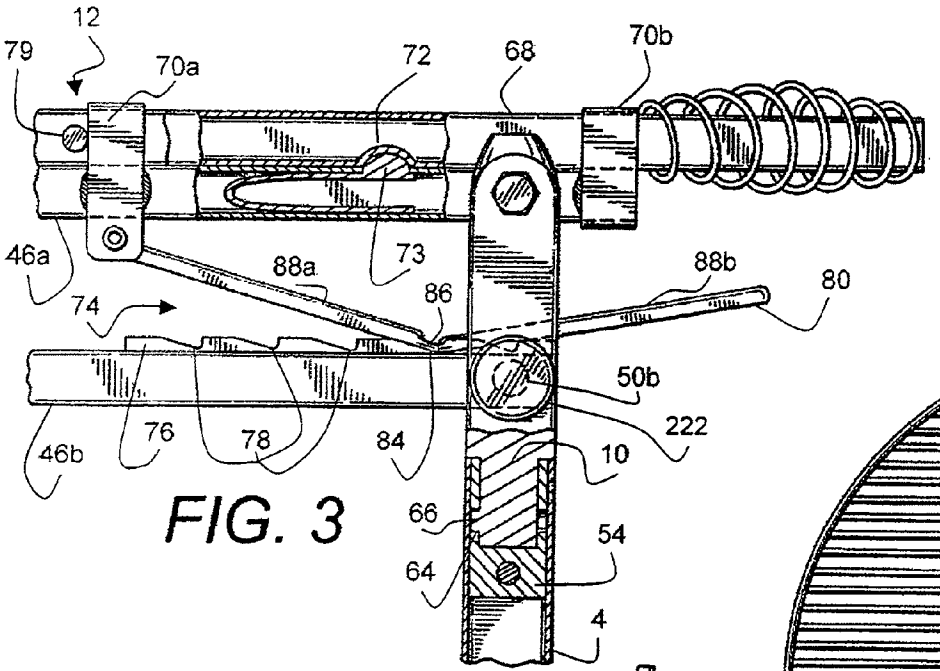
FIG. 3 is side view of the fulcrum of the collapsible grill of FIG. 1.

Referring to FIG. 3, the upright center post 4 has a tubular structure which is adapted to receive an insert 54, such as a bushing, fixed within the post 4, preferably by friction fit; however, any chemical or mechanical fastening means can be provided such as the screw illustrated in the drawings. The insert 54 includes an aperture into which a portion of the forked yoke 10 is inserted and rotatable therein. The insert 54 has a rotation limiting slot 64 therethrough, that extends in a path for a limited distance of about seven-eighths of an inch. A rotation-limiting lug 66 is affixed to the forked yoke 10 and is received in the rotation-limiting slot 64. The support arm 12 which extends from the yoke 10 can therefore rotate only a limited distance between the positions where the limiting lug 66 abuts against each opposite end of the rotation limiting slot 64. This rotation-limiting feature prevents rotating the grill member 22 and the food thereon so far that the grill and stand may begin to tip.

The support arm 12 further includes an extendable, levered handle 68 for manipulating the grill surface 22*a* vertically (up and down) and horizontally (rotating about the center post 4). In the embodiment illustrated, one of the parallel members 46*a*,46*b*, the upper member 46*a*, includes retainers 70*a*,70*b* for receiving a portion of the handle 68, and which are sized to allow the handle 68 to telescope and slide therethrough. A pair of detents selectively hold the handle 68 in either a retracted position or an extended position as one of the detents 72 is aligned with a spring-loaded bearing 73 held within the upper member 46*a* and selectively communicating with the detents through an aperture in the upper member 46*a*. An extension 79 on a distal end of the handle 68 engages one of the retainers 70*a*,70*b* to prevent the handle 68 from separating from the remaining portions of the support arm 12.

The grill 2 further includes a locking mechanism 74 for retaining the grill surface 22*a* at a selected height. This mechanism 74 includes a graduated segment 76 fixedly attached to the supporting arm 12, preferably on an upper surface of the lower parallel member 46*b*. The graduated segment 76 includes a plurality of stops 78 joined by tapered portions 80. Each stop 78 defines a height at which the grill surface 22*a* may be retained by the support arm 12 without outside assistance. The graduated segment 76 is preferably slightly narrower than a width of the lower parallel member 46*b*.

The locking mechanism 74 further includes a trigger 80 pivotally attached to the support arm 12, preferably joined to one of the retainers 70*a*,70*b* adjacent a lower surface of the upper parallel member 46*b*. The trigger 80 is slightly V-shaped and includes a retainer 84 located at an apex 86 of trigger between first and second legs 88*a*, 88*b* for engaging any one of the selected stops 78. The second leg 88*b* is a channeled member, and the retainer 84 is concealed within second leg 88*b* channel. The channel is wide enough so that the graduated segment fits within the channel.

In use, the second leg 88*b* must be lifted to disengage the retainer 84 from the selected stop 78 and lower the grill surface 22*a* by pivoting the support arm 12 about the fulcrum. The tapered portions of the graduated segment 76 allow the grill surface 22*a* to be lifted without lifting the second leg 88*b*.

Figure 4:
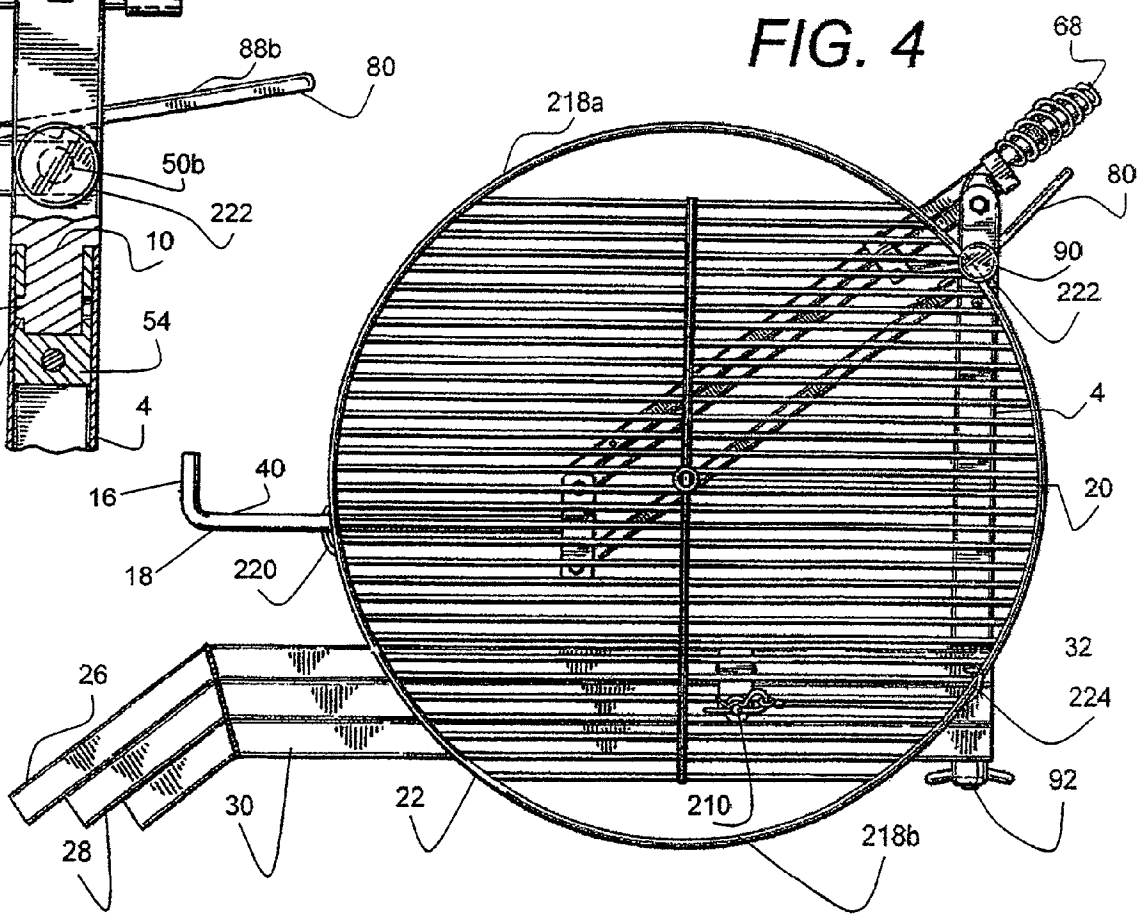
FIG. 4 a side view showing a collapsed grill and stand in accordance with this invention.

Referring now to FIG. 4, when the grill and stand are collapsed, the laterally extending support legs 26, 28 and 30 lie adjacent to one another in vertical, one above the other relationship extending laterally from the upright center post 4. Each leg 26, 28, 30 comprises a horizontal component and a vertical component. Each successive leg has a longer horizontal component and a longer vertical component wherein the legs 26, 28, 30 nest together in vertical alignment.

A grill member retainer 90 extends outwardly from the upright center post 4. The outer ends of the support legs define the outermost point of the collapsed grill and stand at one side thereof and the outermost portion of the handle 68 defines the outermost point of the collapsed grill and stand at the opposite side thereof. The outermost ends of the support legs 28, 29 and 30 define the outermost point of the collapsed grill and stand at the lower end thereof, and the outer member 40 defines the outermost point of the collapsed grill and stand at the upper end thereof. Legs 28 and 30 are removably attached to the post 4 with wing nut 92.

Figure 5:
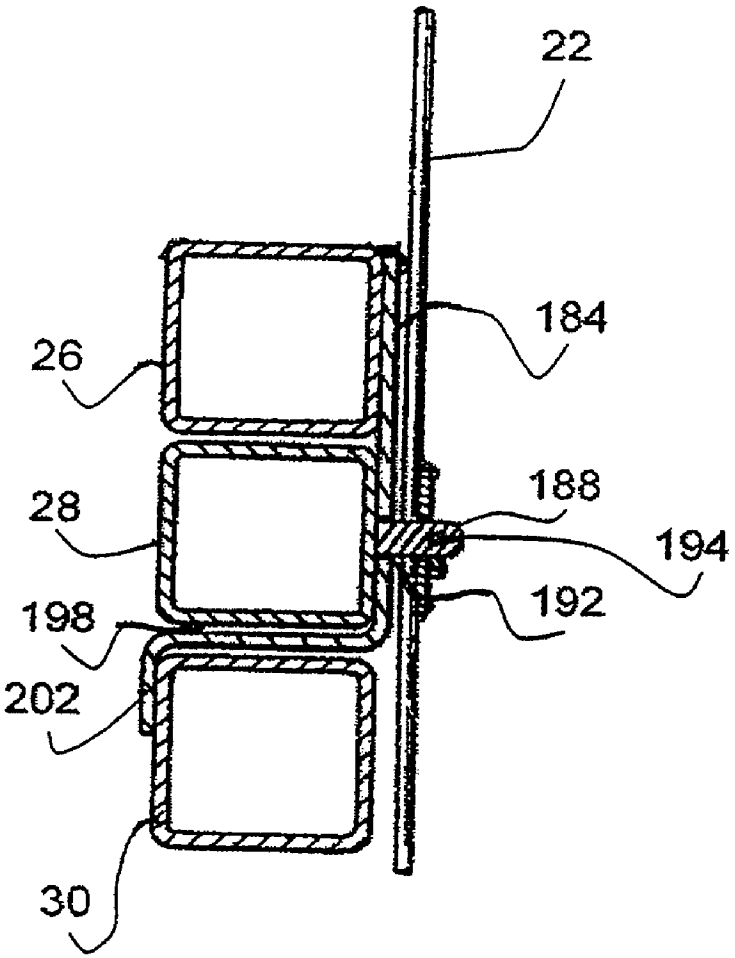
FIG. 5 is a partial cross-sectional showing an over-rotation prevention mechanism on the collapsed grill and stand.

As shown in FIG. 5, the legs 26, 28, 30 include a vertical alignment and over rotation prevention means. This means includes a bracket 180 joined to one of the legs 26, 28, 30, preferably the uppermost leg 26. The bracket may be joined by any suitable means but is preferably fixedly attached by welding. In the illustrated embodiment, the bracket 180 is welded to a vertical side panel of the generally a quadrilateral shaped in cross-section uppermost leg 26. The leg 26 is preferably a rectangular, more preferably a square, in cross-section. Each leg has opposing vertical sides spaced by opposing horizontal sides. It should be understood, however, that the legs 26, 28, 30 may be of any cross-sectional shape as long as the bracket 180 is cooperatively shaped in the manner illustrated, and as explained in more detail below.

The bracket 180 has a first vertical portion 184 which extends downwardly from the vertical side panel of the uppermost leg 26. This vertical 184 portion of the bracket 180 includes means for retaining the legs in vertical alignment. The means may include a specifically shaped bracket which retains the legs with captured fit. This arrangement would be most suitable if a round cross-section were chosen for the legs, but could also be provided with legs 26, 28, 30 illustrated with little or no difficulty.

In the embodiment illustrated, this means includes fastener for joining the second leg 28 to the first leg 26, for example a male/female connection. A male member 188 is joined to a vertical side of the center leg 28, and is alignable with and fits matingly within a first receiver 192 located on the bracket 180 below the lowermost horizontal side of the uppermost leg 26. This first receiver 192 is preferably an aperture.

The fastener's male member 188 includes a second receiver 194, the purpose of which will become clear upon further description. This second receiver 194 is preferably an aperture passing through the body of the male member 188.

The bracket 180 further includes a horizontal portion 198 joined to the first vertical portion 184. The horizontal portion 198 is located below the upper leg 26 and extends in length approximately the width of the upper leg 26 to form a cavity between the upper leg 26 and the horizontal portion 198. The cavity is adapted to receive the second leg 28 therein.

The bracket 180 further has a second vertical portion 202 joined to the horizontal portion 198 and extending downwardly therefrom. The second vertical portion 202 is located opposite the first vertical portion 184 and forms a stop to prevent the third leg 30 from rotating beyond the vertical plane defined by the upper leg 26.

Referring again to FIG. 4, in the collapsed state, the collapsible grill and stand is particularly formed and dimensioned to provide a compact and easily transportable grill and grill stand. In this collapsed state, the legs 26, 28, 30 are in vertical alignment. The legs 26, 28, 30 and the grill member 22 are bound as the male member 188 is fit within and through the first receiver aperture 192 in the bracket 180 wherein the second receiver aperture 192 in the male member 188 extends beyond the bounds of the first vertical portion 184 of the bracket 180.

The grill member 22 includes a third receiver, such as an aperture in a washer joined thereto, preferably by welding. The third receiver aperture is alignable with the male member 188. The third receiver aperture is adapted to receive the male member 188 wherein the second receiver aperture 192 on the male member 188 extends beyond the cooking surface of the grill 22 so that a pin 210 can be inserted through the second receiver 192 to bind the legs 26, 28, 30 and the grill member together. This prevents the legs 26, 28, 30 from unwanted rotation about the center post 4 during transport and/or storage.

The grill member 22 includes handles 218*a*, 218*b*. The handles 218*a*, 218*b* are on a common horizontal plane defined by the cooking surface of the grill member 22. A U-shaped keeper 220 is fixedly attached to outer perimeter of the grill member 22.

In the collapsed state, the outer member 40 of the shaft 12 including the spindle is loosely attached to the U-shaped keeper 220 the outer member 40 through the keeper 220 wherein the keeper 220 is located about the outer member 40. A handle 218*b* forms a carrying handle for the collapsed stand and grill. A portion of the peripheral edge of the grill member 22 extends between a knob 222 and the center post 4. The result is a securely bound collapsed stand and grill with the a convenient carrying handle.

A first profile length of the collapsed grill is defined by the outermost portion of the longest leg to the carrying handle. This first profile length is approximately equal to or slightly longer than the horizontal distance from the outermost portion of the longest leg 26 to the radially outward-most end of the handle 68.

A second profile length of the collapsed grill is approximately equal to the diameter of the grill member 22

A third profile length of the collapsed grill is equal to or just slightly wider that the outermost tip of the male member 88 to an outer portion of the second vertical portion of the bracket 80. This third profile may be increased by the size of the knob 222 or the size of the hub 20 or offsetting the handles 218*a*, 218*b*.

The pin 210 may be attached to the stand 2 by a tether 224, and inserted with an aperture in the stand when the grill 2 is in use.

The terms "first," "second," "upper," "lower," etc. are used for illustrative purposes only and are not intended to limit the embodiments in any way. The term "plurality" as used herein is intended to indicate any number greater than one, either disjunctively or conjunctively as necessary, up to an infinite number. The terms "joined," "attached," and "connected" as used herein are intended to put or bring two elements together so as to form a unit, and any number of elements, devices, fasteners, etc. may be provided between the joined or connected elements unless otherwise specified by the use of the term "directly" and/or supported by the drawings.

While the invention has been described with reference to preferred embodiments, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

What is claimed is:

1. A portable grill comprising:

a grill member;

an upright post comprising a lower end and an upper end, the upper end accommodating a yoke coaxial with the post and rotatably received in the upper end of the post, a plurality of legs pivotally connected to the lower end of the post for supporting the portable grill on a support surface;

a support arm comprising upper and lower parallel members, the upper and lower parallel members each having distal ends pivotally connected to a bracket, the upper and lower parallel members each including proximal ends pivotally connected to the yoke, the bracket and distal ends of the parallel members being coupled to an outer member that extends distally from the bracket and comprises an upturned spindle that is detachably connected to an underside of the grill member for supporting the grill member from beneath the grill member in a level position, the yoke comprising a lug, the upper end of the post comprising a horizontal slot for accommodating the lug and limiting rotational movement of the yoke, support arm and grill about an axis defined by the post and yoke, a handle slidably coupled to the support arm, the handle being slidable away from the grill member to an extended position where downward pressure on the handle raises the grill member while maintaining the grill member in a higher but level position as the proximal ends of the parallel members and the yoke act as a fulcrum and further comprising a locking mechanism for maintaining the grill member at a fixed height above the support surface, the locking mechanism comprising a plurality of stops disposed between graduated segments on the lower parallel member, the upper parallel member coupled to a V-shaped trigger comprising an apex that rests in one of the stops to hold the grill member in a fixed position above the support surface.

2. The portable grill of claim 1 wherein the V-shaped trigger includes a first leg and a second leg separated by the apex, the second leg having a channel adapted to fit over the graduated segments.

3. The portable grill of claim 1 wherein the handle comprises a proximal end with a grip and a distal end that slides along one of the upper or lower parallel members.

4. The portable grill of claim 3 wherein the handle slides along the upper parallel member, which is connected to at least one retainer for coupling the handle to the upper parallel member.

5. The portable grill of claim 3 wherein the handle slides along the upper parallel member, which is connected to at two retainers for coupling the handle to the upper parallel member.

6. The portable grill of claim 2 wherein the handle is detachably secured to the upper parallel member by a ball and detent mechanism when the handle is retracted for storage.

7. The portable grill of claim 1 wherein the legs are pivotable to a storage position where the legs overlie each other and the support arm is pivotable to the storage position where the distal ends of the parallel members and the bracket are directed towards the legs and the grill member is detachably connected to the outer member and the post in the storage position.

8. The portable grill of claim 1 wherein the underside of the grill member comprises a hub for receiving the spindle.

* * * * *